US006871590B1

(12) United States Patent
Hummel et al.

(10) Patent No.: US 6,871,590 B1
(45) Date of Patent: Mar. 29, 2005

(54) INKING SYSTEM FOR A PRINTING MACHINE

(75) Inventors: Peter Hummel, Offenbach (DE); Peter Schramm, Frankfurt/Main (DE); Robert Ortner, Alzenau (DE)

(73) Assignee: MAN Roland Druckmaschinen AG (DE)

( * ) Notice: Subject to any disclaimer, the term of this patent is extended or adjusted under 35 U.S.C. 154(b) by 527 days.

(21) Appl. No.: 10/130,243

(22) PCT Filed: Nov. 21, 2000

(86) PCT No.: PCT/EP00/11549

§ 371 (c)(1),
(2), (4) Date: Aug. 5, 2002

(87) PCT Pub. No.: WO01/38095

PCT Pub. Date: May 31, 2001

(30) Foreign Application Priority Data

Nov. 23, 1999 (DE) ..... 199 56 149

(51) Int. Cl.[7] ..... B41F 31/00

(52) U.S. Cl. ..... 101/349.1; 101/350.4; 101/363

(58) Field of Search ..... 101/148, 348, 101/350.4, 349.1, 350.1, 352.02, 352.04, 216–217, 230, 483, 363–367

(56) References Cited

U.S. PATENT DOCUMENTS 3,404,625 A * 10/1968 White ..... 101/148
3,701,316 A * 10/1972 Sylvester et al. ..... 101/148
4,041,864 A * 8/1977 Dahlgren et al. ..... 101/350.4
4,127,067 A * 11/1978 Dahlgren et al. ..... 101/451
4,233,898 A * 11/1980 Dahlgren ..... 101/138
4,470,347 A * 9/1984 Johne et al. ..... 101/148
4,530,283 A * 7/1985 Mathes et al. ..... 101/230
4,823,450 A * 4/1989 Ramisch et al. ..... 492/7
5,003,871 A 4/1991 Franz et al. ..... 101/148
5,440,981 A * 8/1995 Vrotacoe et al. ..... 101/217
5,460,088 A * 10/1995 Heiler et al. ..... 101/142
6,098,542 A * 8/2000 Dufour ..... 101/352.05
6,352,027 B1 * 3/2002 Wadlinger ..... 101/216

FOREIGN PATENT DOCUMENTS

| | | |
|---|---|---|
| DE | 30 08 981 A | 9/1981 |
| DE | 37 06 602 C1 | 9/1988 |
| EP | 0 144 671 A1 | 6/1985 |
| FR | 574 658 | 7/1924 |

* cited by examiner

*Primary Examiner*—Eugene H. Eickholt
(74) *Attorney, Agent, or Firm*—Leydig, Voit & Mayer, Ltd.

(57) ABSTRACT

An inking system for a printing machine which has a relatively simple design and which is adapted for more stable ink transfer to a plate cylinder. The inking system includes an ink supply roller (15), one or more drivable inking unit rollers (14, 19), an adjustment system for establishing a predetermined nip (19) between the ink supply roller and one of the drivable unit inking rollers (14, 19), and at least one movable calender roller (10) in constant contact with one of the drivable inking unit rollers operable for selectively interrupting the ink transfer.

13 Claims, 5 Drawing Sheets

INKING SYSTEM FOR A PRINTING MACHINE

FIELD OF THE INVENTION

The invention pertains to an inking system for a printing machine.

BACKGROUND OF THE INVENTION

DE 30 08 981 A1 discloses an inking system for a printing machine which can be changed between lifting-/film-inking systems. The inking unit consists of an ink duct with a preceding ink duct roller and a lifting roller that swivels between the ink duct roller and a subsequent inking unit roller. The lifting roller is disconnected if an additional roller is positioned between the ink duct roller and the subsequent inking unit roller.

A lifting inking system is known from DE 37 06 602 C2. According to this publication, the printing ink to be processed is transferred from an ink duct roller that serves as the ink supply roller to a first inking unit roller (1st ink distribution roller) by means of an ink lifting roller. An inking roller train with several ink application rollers that adjoin a plate cylinder is arranged behind the first inking unit roller. Here, a first preceding ink application roller is coupled to a subsequent ink application roller, as viewed in the direction of rotation of the plate cylinder, by means of an ink distribution roller. In the inking unit roller train that lies above, an ink distribution roller is arranged which is functionally connected to the ink supply (ink duct roller, ink lifting roller and first ink distribution roller) on the one hand, and to a first roller train and a second, parallel roller train that contains the ink application rollers which adjoin the plate cylinder.

A transfer inking system for a printing machine also is known from FR 574 658. In this case, the oscillating ink lifting roller is arranged between the ink duct roller and the subsequent ink duct roller with the roller train. At least one first calender roll that is movably supported and in constant frictional contact with the subsequent inking unit roller is assigned to this inking unit roller, wherein the ink transport to the roller train can be periodically interrupted between the first calender roll and the subsequent second inking unit roller. The movement of the lifting roller is coupled to the movement of the calender rolls by means of a common cam control.

The masses being moved in these ink supply systems cause undesirable vibrations in the system. In an ink supply system utilizing an ink lifting roller, a lifting impact occurs when the lifting roller contacts the first ink distribution roller, which can cause undesirable vibrations in the inking system. In addition, ink density fluctuations occur in the inking system due to the ink lifting strip. These ink density fluctuations can be reduced with a series of nips (i.e. as defined by a large number of inking rollers in the roller train).

OBJECTS AND SUMMARY OF THE INVENTION

It is an object of the invention to provide an inking system for a printing machine which eliminates the foregoing disadvantages and permits the stable transport of ink through the system. A related object is to provide an inking system of the foregoing type that is simple in design and economical to manufacture.

One advantage of the inking system according to the invention is that the number of rollers in the roller train can be significantly reduced. Another advantage is that no lifting impact occurs that adversely affects the ink transfer.

It is also advantageous that that ink density fluctuations are significantly reduced. Moreover, a stable ink transport can be achieved with a roller train having a fewer number of inking rollers.

Another advantage is that the ink flow in the inking system can be interrupted cyclically, particularly on the first inking unit roller (i.e. either the 1st or 2nd ink distributor) for the ink supply, and that the ink film transferred by the ink supply roller (e.g., the ink duct roller) is simultaneously leveled on the outer surface of this inking unit roller (either the 1st or 2nd ink distributor).

It also is advantageous that the movement of the ink supply roller preferably can be coupled to the movement of at least one calender roll that adjoins a first drivable inking unit roller (1st ink distributor) and/or the second drivable inking unit roller (2nd ink distributor) in order to accelerate the formation of the desired ink film.

The inventive supply system further is operable with short, rapid reaction times which enhances printing quality and stabilizes the printing process.

Other objects and advantages of the invention will become apparent upon reading the following detailed description and upon reference to the drawings, in which:

Figure 1:
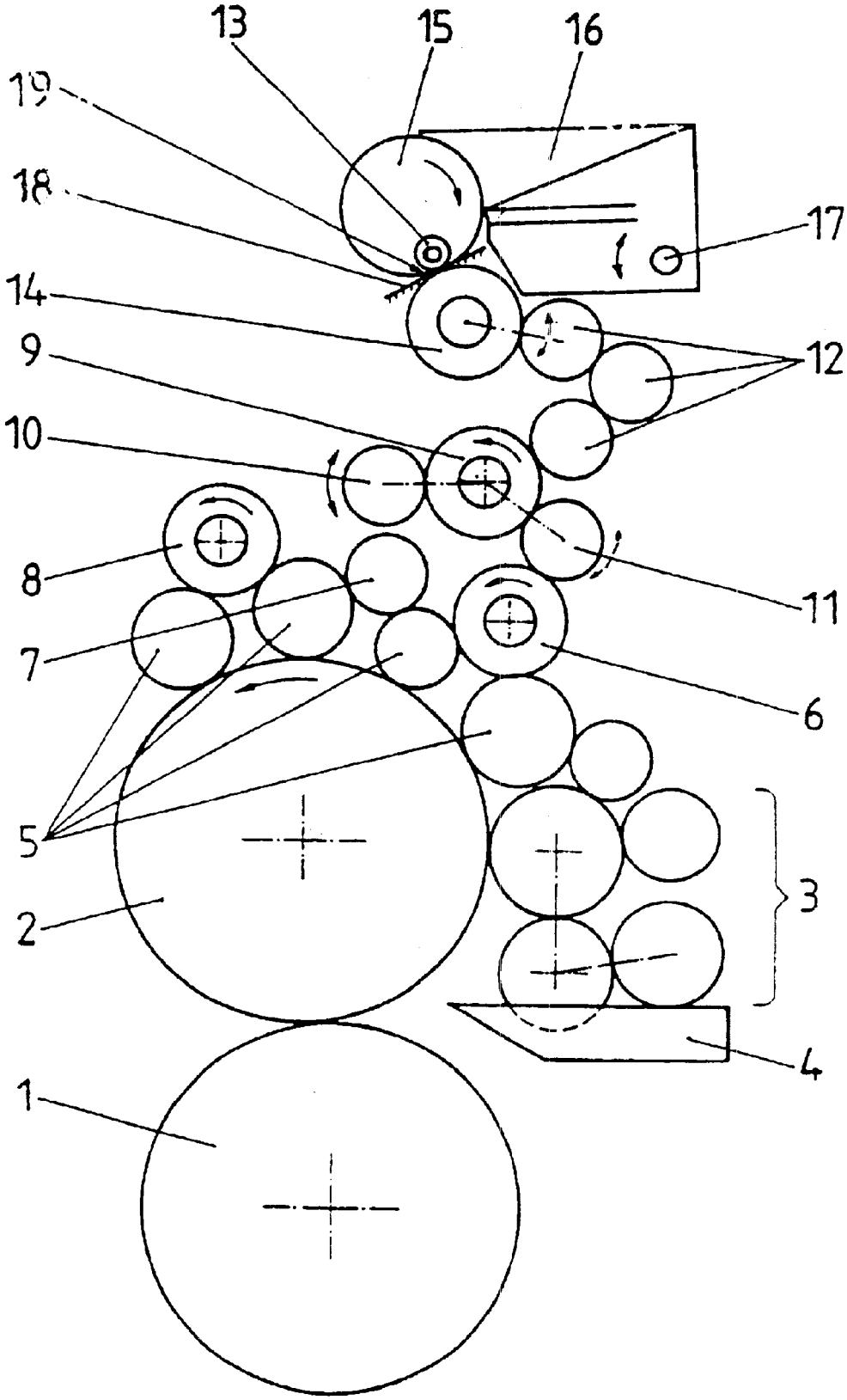
FIG. 1 is a partially diagrammatic depiction of a printing machine having an inking system in accordance with the invention with a constant operating ink supply.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Referring now more particularly to FIG. 1 of the drawings, there is shown an illustrative offset printing machine having an illustrative inking system in accordance with the invention. The printing machine includes a conventional plate cylinder 2 mounted adjacent a rubber blanket cylinder 1, which may be mounted adjacent a guide cylinder 3 through which printable material is directed into the nip between the plate cylinder and blanket cylinder. For a wet offset printing mode, a wetting system 3 with a wetting agent container 4 is mounted adjacent the plate cylinder 2, with the wetting system being arranged ahead of the inking system, as viewed in the direction of rotation of the plate cylinder. The wetting system 3 preferably can be integrated into the inking system by means of a switchable bridge roller. However, the printing system may alternatively be operated in the dry offset printing mode (offset printing without wetting agent). For this purpose, the wetting system 3 or at least the wetting agent application roller can be separated from the plate cylinder 2 and/or disconnected from at least the wetting agent supply, or the printing system otherwise is operable without the wetting system 3.

The inking system consists, among other things, of an ink supply system that is formed by at least one drivable ink supply roller 15 that can be inked. In the illustrated embodiment, the ink supply roller 15 consists of an ink duct roller that is functionally connected to an ink metering device and an ink duct 16. Alternatively, the ink supply system could include at least one ink dispensing device that is directly assigned to the ink supply roller 15 and preferably can be displaced axially relative to the ink supply roller 15.

Figure 2:
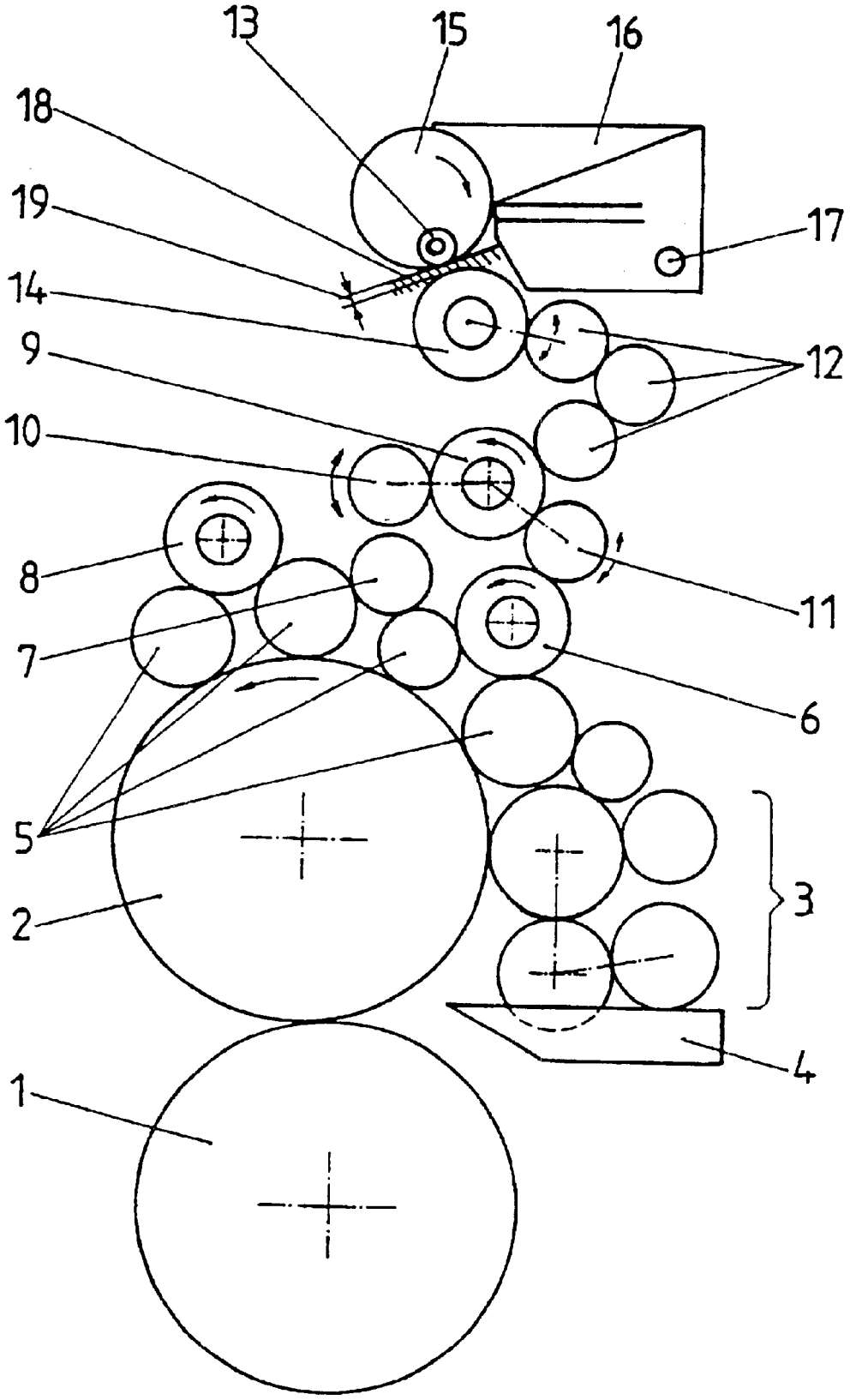
FIG. 2. is a diagrammatic depiction, similar to FIG. 1, showing an inking system with cyclic ink supply.

According to FIGS. 1 and 2, the ink supply roller 15 is functionally connected to a first inking unit roller 14 (1st ink distributor) that is arranged directly behind this ink supply roller in the inking system. The first inking roller 14 preferably is rotatably driven and axially transversible. A roller train that, among other things, is functionally connected to a series of ink application rollers 5 for the plate cylinder 2 is arranged behind the first inking unit roller 14 (1st ink distributor).

In the roller train shown in FIGS. 1 and 2, for example, three lifting rollers 12 are arranged behind the drivable first inking unit roller 14. A second inking unit roller 9 (2nd ink distributor) that preferably also can be rotatably driven and axially traversed follows the lifting rollers 12. A first calender roll 10 is assigned to and in constant frictional contact with the circumference of the second inking unit roller 9, wherein this first calender roll can periodically be functionally connected to an inking roller 7; in this case a distribution roller that follows in the direction of rotation the plate cylinder 2. This inking roller 7 preferably is in direct contact with two ink application rollers 5 (2nd and 3rd ink application rollers as viewed in the direction of rotation of the plate cylinder) that are assigned to the plate cylinder 2. The ink transport to the roller train that contains at least one ink application roller 5 can be interrupted at an interrupt point with the movably supported calender roll 10.

According to FIGS. 1 and 2, the lifting roller 11 is in constant contact with and assigned to the second inking unit roller 9 in addition to the first calender roll 10. As viewed in the direction of the plate cylinder 2, a third inking unit roller 6 (3rd ink distributor) that preferably can be axially traversed and, in particular, rotationally driven is in constant contact with and assigned to the lifting roller 11, wherein this third inking unit roller is in contact with two ink application rollers 5. These ink application rollers 5 are arranged in the form of first and second ink application rollers 5 in the direction of rotation of the plate cylinder 2. Two additional ink application rollers 5 (3rd and 4th ink application rollers, as viewed in the direction of rotation of the plate cylinder) are also arranged behind the first and the second ink application rollers 5, as viewed in the direction of rotation of the plate cylinder 2, wherein these additional ink application rollers are functionally connected to a fourth inking unit roller 8 (4th ink distributor) that also preferably can be rotatably driven and axially traversed.

In keeping with the invention, the inking system includes an adjustment system 13 for the ink supply roller 15 which permits selective adjustment in the ink supply. For example, this adjustment system may consist of an eccentrically adjustable cam roller for adjusting the nip 19 between the ink supply roller 15 and the first inking unit roller 14 (FIGS. 1 and 2). The adjustment system 13 preferably is in contact with a selectively stationary or movable limit stop 18 or, alternatively, a radial cam.

The nip 19 between the ink supply roller 15 and the first inking unit roller 14 (1st ink distributor) can be adjusted to a defined size by means of the adjustment system 13 and the limit stop 18 in order to adjust the desired film thickness, wherein the size of the nip is preferably less than 1 mm. In this case, the ink is directly transferred from the ink supply roller 15 to the first inking unit roller 14 by means of ink separation. Consequently, a thin and uninterrupted ink layer (ink film) can be transferred to the subsequent roller train from the nip 19. In the embodiment of FIG. 1, the ink layer is of a constant size such that a constant ink supply is produced by the inking system. The additional refinement of the ink duct 16 with a rotary joint 17, which will be described in connection with the FIG. 2 embodiment, below may be disconnected.

In the embodiment according to FIG. 2, the ink duct 16 with the ink supply roller 15 is supported in at least one rotary joint 17 for selected rotation. The ink duct 16 with the ink supply roller 15 (and the ink metering device) can cyclically be pivoted in the rotary joint 17 by means of an appropriate actuating device and moved toward or away from the first inking unit roller 14 which is stationarily supported on the frame. For example, at least one working cylinder or at least one movable limit stop 18 may be used as the actuating device. The nip 19 thereby can be adjusted to a defined size that ensures that the film has the desired thickness and that the ink supply roller 15 does not come in contact with the first inking unit roller 14. Due to the cyclical oscillatory movement of the ink supply roller 15, the adjusted nip 19, which is increased by the (metered) layer thickness located on the ink supply roller 15, the ink film transferred to the first inking unit roller 14 can be interrupted cyclically. Thus, a thin layer of ink (ink film) can only be periodically transferred to the subsequent roller train.

This cyclical operation of the ink supply roller 15 is synchronously or asynchronously significant if the plate cylinder 2 includes a channel. This type of operation can also be used to take into account the printing subject.

The ink metering device preferably is arranged ahead of the nip 19, as viewed in the direction of rotation of the ink supply roller 15. In the embodiments according to FIGS. 1 and 2, the lifting roller 11 may alternatively be in the form of a calender roll (2nd calender roll). In this case, the lifting roller 11 is in constant frictional contact with the second inking unit roller 9 and can be periodically brought in contact with the subsequent third inking unit roller 6.

In another embodiment, the lifting roller 12 that is arranged directly adjacent to the first inking unit roller 14 (1st ink distributor) may also be in the form of a calender roll. This lifting roller 12 is in constant contact with the first inking unit roller 14 and can be periodically brought in contact with the subsequent lifting roller 12.

In another alternative embodiment of an inking system according to the invention, the lifting roller 12 may be in the form of a calender roll assigned to the first inking unit roller 14, and at least one calender roll 10 is assigned to the second inking unit roller 9.

It will be understood by a person skilled in the art that the inking unit according to FIGS. 1 and 2 includes a relatively long roller train, i.e., with numerous rollers and a correspondingly high number of nips.

Figure 3:
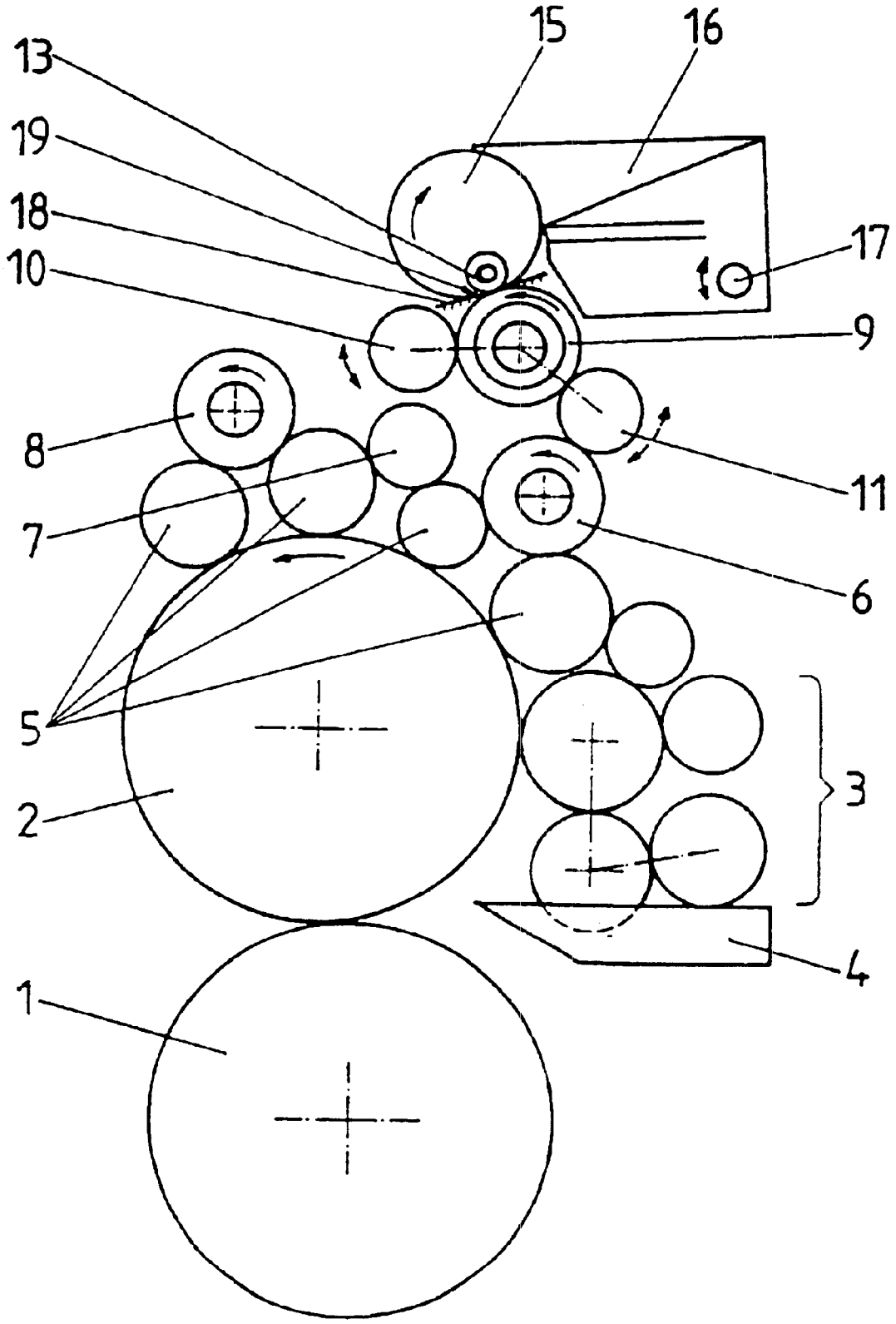
FIG. 3 is a diagrammatic depiction of a printing machine having an alternative embodiment of ink supply system with a constant ink supply.
Figure 4:
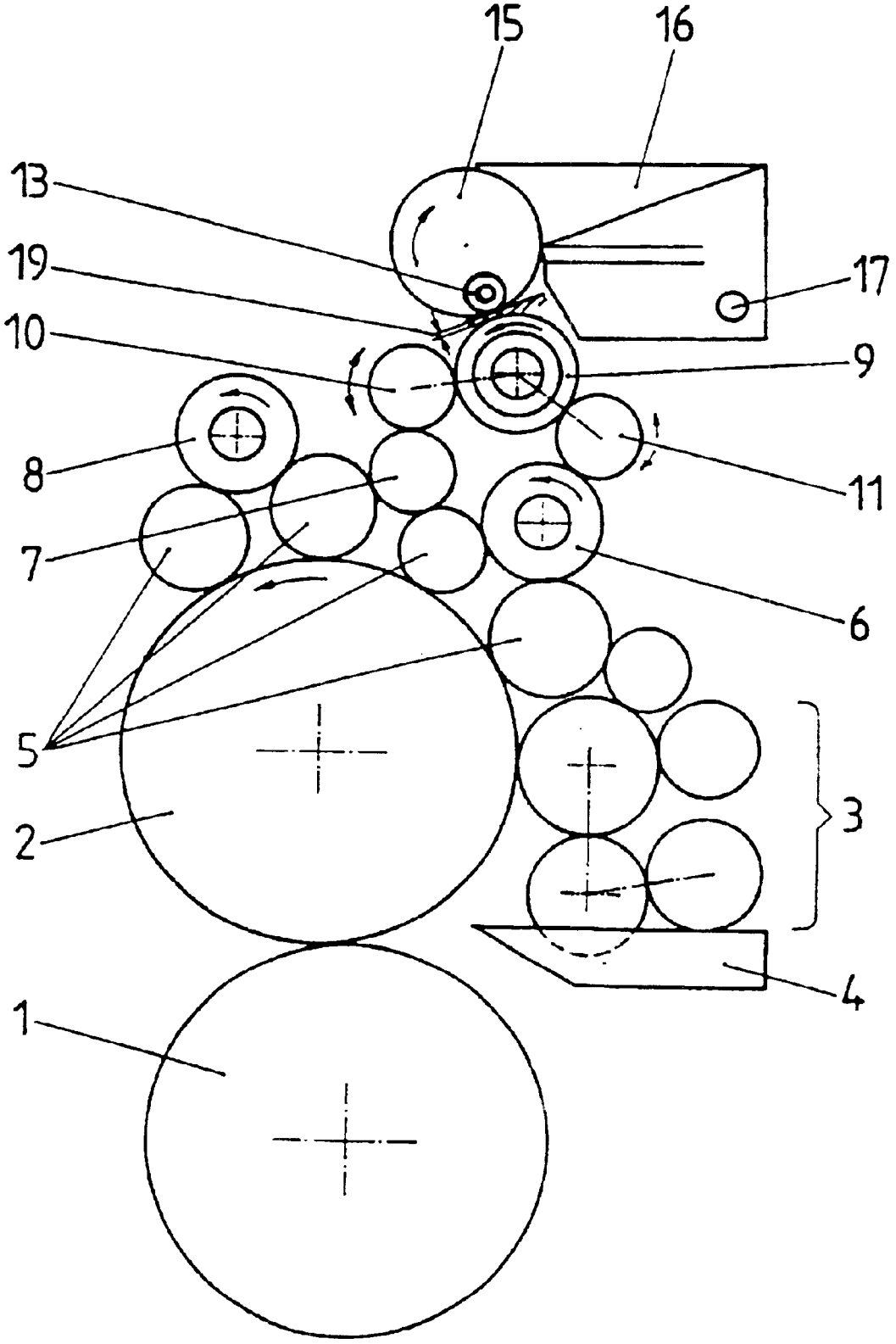
FIG. 4. is partially diagrammatic depiction of an alternative embodiment of a printing machine having an inking system with a cyclic ink supply.
Figure 5:
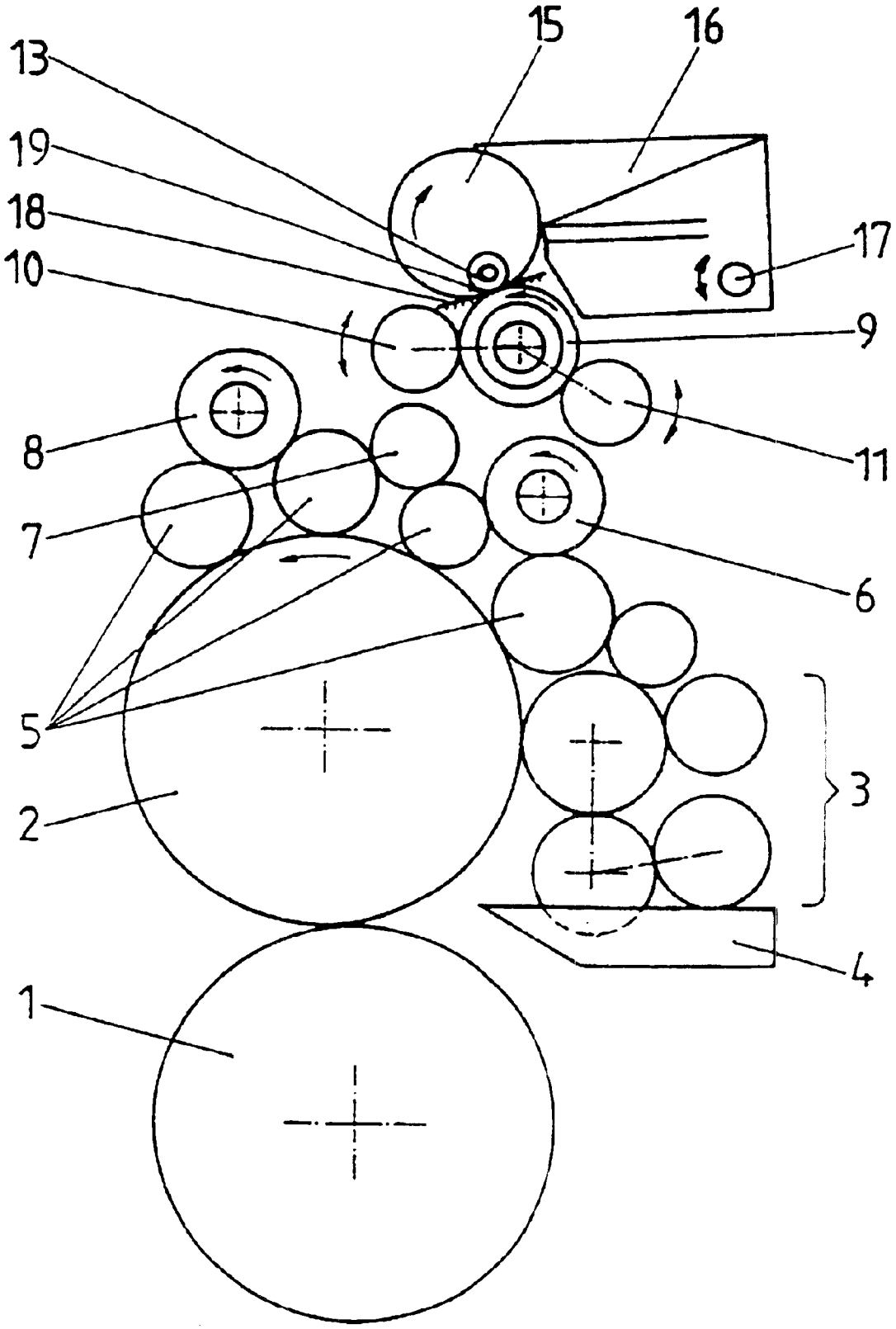
FIG. 5 is an alternative embodiment of printing machine having an inking system with a constant ink supply and a pair of calendar rollers in the roller train.

In the embodiments of FIGS. 3–5, the inking unit roller train is reduced by eliminating the lifting rollers 12 and the first inking unit roller 14 (1st ink distributor). The ink transfer to the second inking unit roller 9 (2nd ink distributor), which preferably can be rotatably driven and axially traversed, is directly next to the supply roller 15 and operatively connected to the adjustment system 13. Hence, a defined nip 19 can be fixed between the rollers 15, 9 by means of the adjustment system 13. The first calender roll 10 is assigned to and in constant frictional contact with the circumference of the second inking unit roller 9, wherein said calender roll can periodically be functionally engaged with the subsequent inking unit roller 7 (distribution roller), as viewed in the direction of the plate cylinder 2 which, in turn, is in contact with two ink application rollers 5. The calender roll 10 is frictionally engaged with the inking unit roller 9 and movably supported in such a way that the ink transport to the roller train can be periodically interrupted with at least one ink application roller 5.

The lifting roller 11 is also assigned to and in constant contact with the circumference of the second inking unit roller 9. As viewed in the direction of the plate cylinder 2, the third inking unit roller 6 (3rd ink distributor), which preferably can be rotatably driven and axially traversed, is arranged behind and in constant contact with the lifting roller 11, wherein the third inking unit roller is in contact with the two subsequent ink application rollers 5 (1st and 2nd ink application rollers). As viewed in the direction of rotation of the plate cylinder 2, two additional ink application rollers 5 which are in contact with the fourth inking unit roller 8 (4th ink distributor), which also preferably can be rotatably driven and axially traversed, are arranged behind the aforementioned ink application rollers 5.

According to FIGS. 3–5, the ink metering device preferably is arranged ahead of the nip 19, as viewed in the direction of rotation of the ink supply roller 15. Alternatively, it would also be possible to use an ink dispensing device that can be axially displaced relative to the ink supply roller 15.

According to the embodiment of FIG. 3, a constant ink transfer to the subsequent second inking unit roller 9 can be realized between the ink supply roller 15 and the second inking unit roller 9 (2nd ink distributor) if the adjustment system 13 is used to set a defined nip size for the nip 19. The ink duct 16 with the ink supply roller 15 that can be inked and is supported in the rotary joint 17 which can be shut off. The ink transfer takes place directly from the ink supply roller 15 to the second inking unit roller 9 by means of ink separation in the nip 19, the size of which is preferably less than 1 mm. The lifting roller 11 selectively operates as a calender roll or is in constant contact with the second inking unit roller 9 (2nd ink distributor) and the third inking unit roller 6 (3rd ink distributor). In these embodiments, a periodic or constant flow of ink is ensured via the front roller train. However, the connection between the first calender roll 10 and the inking roller 7 (distribution roller) can be periodically interrupted.

According to the embodiment of FIG. 4, the ink duct 16 with the ink supply roller 15 can be periodically moved toward or away from the second inking unit roller 9 (2nd ink distributor) about the axis of the rotary joint 17 by means of an actuating device, e.g., at least one working cylinder or a limit stop 18. In order to effect the ink transfer, the adjustment system 13 (preferably with limit stop 18) for adjusting the nip 19 between the ink supply roller 15 and the second inking unit roller 9 for the desired film thickness is provided for the ink supply roller 15. The nip 19 ensures that no contact with the inking unit roller 9 takes place in this case. According to the embodiment of FIG. 4, a periodic ink transfer (analogous to FIG. 2) can be realized due to the preferred oscillatory movement of the ink supply roller 15. Thus, the transfer of the ink film to the second inking unit roller 9 is interrupted cyclically such that an ink layer (ink film) is only periodically transferred to the subsequent roller train.

At least one calender roll 10 and one lifting roller 11 are assigned to the second inking unit roller 9 (2nd ink distributor), wherein the lifting roller 11 may also be in the form of a second calender roll. The circumference of the calender roll 10 is in contact with the second inking unit roller 9 and can be periodically brought in contact with the inking roller 7 (distribution roller). The circumference of the lifting roller 11 is in constant contact with the second inking unit roller 9 (2nd ink distributor) and with the subsequent third inking unit roller 6 (3rd ink distributor). Alternatively, the lifting roller 11 may also be in the form of a second calender roll (analogous to the calender roll 10) and periodically brought in contact with the third inking unit roller 6 (3rd ink distributor).

In the embodiment of FIG. 5, the preferred inking unit is similar to FIG. 3. The ink supply roller 15 that can be inked and the ink duct 16 rotary joint 17 may be shut down. A constant transfer of ink can be realized with the nip 19 that is fixed by means of the adjustment system 13.

Alternatively, the ink supply roller 15, similar to the embodiment of FIG. 4, can be moved cyclically in order to periodically increase the defined nip 19 and realize a cyclical ink transfer.

According to the embodiment of FIG. 5, two calender rolls, 10, 11 (the lifting roller 11 being in the form of a calender roll) are assigned to the circumference of the second inking unit roller 9.

The rotatably drivable ink supply roller 15 is, according to one embodiment, coupled to the oscillatory movement of at least the first calender roll 10 (and preferably also the lifting roller 11 is in the form of a calender roll) by means of a corresponding gear such that the rollers 15, 10, 11 can be driven synchronously.

In another embodiment, two separate gears are used, wherein the ink supply roller 15 can be selectively driven synchronously or, as preferred, asynchronously relative to the first calender roll 10 and the lifting roller 11, respectively.

The ink transfer from the drivable ink supply roller 15 that can be inked to the drivable first inking unit roller 14 (according to FIGS. 1–2) takes place in the nip 19. This means that the ink supply roller 15 and the first inking unit roller 14 do not contact one another. Depending on the adjusted thickness of the film layer (by means of the adjustment system 13), the inking unit roller 14 constantly or periodically (in case of a cyclical ink supply roller 15) receives the printing ink from the ink supply roller 15 and transfers the printing ink to the subsequent lifting rollers 12.

The printing ink is transferred from the lifting rollers 12 to the drivable second inking unit roller 9 by means of ink separation. If the first lifting roller 12 that frictionally adjoins the ink supply roller 15 is in the form of a calender roll that oscillates about the ink supply roller, the ink film on the ink supply roller 15 is leveled and periodically transferred to the subsequent lifting roller 12.

The calender roll 10 frictionally adjoins the second inking unit roller 9 and oscillates about the axis of the inking unit roller 9 in such a way that the calender roll 10 remains in constant frictional contact with the inking unit roller 9 and the ink flow to the subsequent inking roller 7 can simultaneously be periodically interrupted. In this embodiment, the calender roll 10 levels the ink film situated on the outer surface of the inking unit roller 9 into a uniform ink film. The ink is periodically transferred to the inking roller 7 and then to the ink application rollers 5, including the fourth inking unit roller 8. The lifting roller 11 also is in constant frictional contact with the inking unit roller 9. The lifting roller 11 preferably is selectively operated for a constant transfer of the ink due to its contact with the subsequent third inking unit roller or is in the form of a calender roll, analogously to the calender roll 10, for periodic ink transfer.

In the embodiments according to FIGS. 3–5, the ink is directly transferred from the ink supply roller 15 to the second inking unit roller 9. Further ink transfer takes place analogously to the above-described procedure.

What is claimed is:

1. An inking system in a printing machine having a plate cylinder comprising:

an ink supply unit including a drivable ink supply roller (15);

a first drivable inking unit roller (14) adjacent the ink supply roller (15);

an adjustment system (13) for effecting a defined nip (19) between said ink supply roller (15) and said first drivable inking unit roller (14);

at least one lifting roller (12) arranged in a downstream ink flow direction from said first drivable inking unit roller (14);

a second drivable inking unit roller (9) following said at least one lifting roller (12) in an ink transfer direction;

at least one application roller (5) in contact with said plate cylinder;

a first calender roller (10) in constant frictional contact with said second inking unit roller (9); and said first calender roller (10) being movably supported for periodically interrupting the transfer of ink to said at least one ink application roller (5).

2. The inking system of claim 1 including a plurality of said lifting rollers (12), said first drivable inking unit roller (14) being in contact with one of said plurality of lifting rollers (12) in an ink transfer direction and said second drivable inking unit roller (9) being in contact with another of lifting rollers (12) in an ink transfer direction.

3. The inking system of claim 1 including a further lifting roller (11) in constant frictional contact with said second drivable inking unit roller (9), a third drivable inking unit roller (6) following said further lifting roller (11) in an ink transfer direction, a plurality of said application rollers (5), and said third drivable inking unit roller (6) being functionally connected to at least one of said ink application rollers (5).

4. The inking system of claim 3 in which said further lifting roller (11) is in constant contact with said third inking unit roller (6).

5. The inking system of claim 3 in which said further lifting roller (11) is in the form of a calender roller and is periodically movable into contact with said third drivable inking unit roller (6).

6. The inking system of claim 1 in which said ink supply roller (15) is cyclically movable relative to said first drivable unit inking roller (14) for periodically increasing said nip (19).

7. The inking system of claim 1 including a plurality of said lifting rollers (12), a first said lifting roller (12) in constant frictional contact with said first drivable unit inking roller (14), said first lifting roller (12) being in the form of a movable calender roller for periodically interrupting the transport of ink to a subsequent lifting roller (12) in an ink transfer direction.

8. An inking system in a printing machine having a plate cylinder comprising:

an ink supply unit including a drivable ink supply roller (15);

a drivable inking unit roller (9) adjacent the ink supply roller (15);

an adjustment system (13) for effecting a defined nip (19) between said ink supply roller (15) and said drivable inking unit roller (9);

a calender roller (10) in constant frictional contact with said drivable inking unit roller (9);

and said first calender roller (10) being movably supported such that ink transport to a roll train containing at least one ink application roller (5) in contact with said plate cylinder may be periodically interrupted at a predetermined interruption point.

9. The inking system of claim 8 including a lifting roller (11) in constant frictional contact with said drivable inking unit roller (9), a further drivable inking unit roller (6) following said further lifting roller (11) in an ink transfer direction, a plurality of said application rollers (5), and said further drivable inking unit roller (6) being functionally connected to at least one of said ink application rollers (5).

10. The inking system of claim 9 in which said lifting roller (11) is in constant contact with said further inking unit roller (6).

11. The inking system of claim 9 in which said lifting roller (11) is in the form of a calender roller and is periodically movable into contact with said further drivable inking unit roller (6).

12. The inking system of claim 8 in which said ink supply roller (15) is cyclically movable relative to said drivable inking unit (9) for periodically increasing the defined nip (19).

13. The inking system of claim 9 in which said at least one lifting roller (12) is in the form of a movable calender roller for periodically interrupting the transport of ink to a subsequent lifting roller (12) in an ink transfer direction.

* * * * *